US009022509B2

(12) United States Patent
Sonehara

(10) Patent No.: US 9,022,509 B2
(45) Date of Patent: May 5, 2015

(54) IMAGE RECORDING APPARATUS, IMAGE RECORDING METHOD, PROGRAM, AND PROGRAM RECORDING MEDIUM FOR PREVENTING MOISTURE INFILTRATION TO A RECORDING MEDIUM

(75) Inventor: Hideaki Sonehara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 313 days.

(21) Appl. No.: 13/554,177

(22) Filed: Jul. 20, 2012

(65) Prior Publication Data

US 2013/0021403 A1 Jan. 24, 2013

(30) Foreign Application Priority Data

Jul. 21, 2011 (JP) ..... 2011-159645

(51) Int. Cl.

| | |
|---|---|
| ***B41J 29/38*** | (2006.01) |
| ***B41J 2/01*** | (2006.01) |
| ***B41J 2/21*** | (2006.01) |
| ***B41J 11/00*** | (2006.01) |

(52) U.S. Cl.

CPC ..... *B41J 2/2114* (2013.01); *B41J 11/0015* (2013.01)

(58) Field of Classification Search

CPC ..... B41J 11/0015; B41J 2/2114

USPC ..... 347/16, 20, 101, 106; 235/488; 428/195.1

See application file for complete search history.

(56) References Cited

U.S. PATENT DOCUMENTS

| | | | | |
|---|---|---|---|---|
| 2004/0066441 | A1* | 4/2004 | Jones et al. | 347/101 |
| 2005/0030363 | A1* | 2/2005 | De Vries et al. | 347/106 |
| 2008/0135624 | A1* | 6/2008 | Leenders et al. | 235/488 |

FOREIGN PATENT DOCUMENTS

| | | |
|---|---|---|
| JP | 2006-213035 | 8/2006 |
| JP | 2008-001014 | 1/2008 |

* cited by examiner

*Primary Examiner* — Julian Huffman
*Assistant Examiner* — Carlos A Martinez
(74) *Attorney, Agent, or Firm* — Workman Nydegger

(57) ABSTRACT

An image recording apparatus forms an image on a recording medium including a liquid accommodation layer by landing a liquid to the liquid accommodation layer of the recording medium. The image recording apparatus includes a first unit that performs pre-processing of landing the liquid containing a material with absorbability lower than that of the liquid accommodation layer to an edge of an image formation region at which the image is scheduled to be formed; and a second unit that forms the image at the image formation region of the recording medium after the first unit performs the pre-processing.

10 Claims, 5 Drawing Sheets

IMAGE RECORDING APPARATUS, IMAGE RECORDING METHOD, PROGRAM, AND PROGRAM RECORDING MEDIUM FOR PREVENTING MOISTURE INFILTRATION TO A RECORDING MEDIUM

BACKGROUND

1. Technical Field

The present invention relates to an image recording technology for landing a liquid on a recording medium including a liquid accommodation layer accommodating a liquid and recording an image.

2. Related Art

Hitherto, image recording technologies for ejecting ink as a liquid toward a recording medium including an ink accommodation layer in accordance with an ink jet method and landing the ink to the ink accommodation layer to print an image have been known. As disclosed in JP-A-2008-001014, post-processing such as a laminating process is performed on an ink accommodation layer of a recording medium on which an image is printed in order to improve the durability of the image printed on the recording medium.

However, when a label image or the like is printed using the above-mentioned image recording technology, a single label image or a plurality of label images are printed on a recording medium. Further, in post-processing on the recording medium subjected to the image printing, a cutting process of cutting the recording medium subjected to a laminating process for each label image is performed in addition to the above-mentioned laminating process. However, moisture may infiltrate into a liquid acceptor (ink acceptor) via the cut surface after the cutting process, and therefore the liquid acceptor may be turbid in some cases.

SUMMARY

An advantage of some aspects of the invention is that it provides an image recording technology for landing a liquid on a recording medium having a liquid acceptor to record an image, and preventing moisture from infiltrating from a cut surface of the recording medium to prevent the liquid acceptor from being turbid, even when the recording medium is cut for each image by post-processing of the image recording.

According to an aspect of the invention, there is provided an image recording apparatus that forms an image on a recording medium including a liquid accommodation layer by landing a liquid to the liquid accommodation layer of the recording medium. The image recording apparatus includes: a first unit that performs pre-processing of landing the liquid containing a material with absorbability lower than that of the liquid accommodation layer to an edge of an image formation region at which the image is scheduled to be formed; and a second unit that forms the image at the image formation region of the recording medium after the first unit performs the pre-processing.

According to another aspect of the invention, there is provided an image recording method of forming an image on a recording medium including a liquid accommodation layer by landing a liquid to the liquid accommodation layer of the recording medium. The image recording method includes: performing pre-processing of landing the liquid containing a material with absorbability lower than that of the liquid accommodation layer to an edge of an image formation region at which the image is scheduled to be formed; and forming the image at the image formation region of the recording medium after performing the pre-processing.

According to still another aspect of the invention, there is provided a program causing an image recording apparatus to form an image on a recording medium including a liquid accommodation layer by landing a liquid to the liquid accommodation layer of the recording medium using a computer. The program causes the computer to execute: performing pre-processing of landing the liquid containing a material with absorbability lower than that of the liquid accommodation layer to an edge of an image formation region at which the image is scheduled to be formed; and forming the image at the image formation region of the recording medium after performing the pre-processing.

According to further still another aspect of the invention, there is provided a program recording medium recording the program described above.

According to the aspects of the invention (the image recording apparatus, the image recording method, the program, and the program recording medium), the pre-processing is performed to land the liquid containing the material with absorbability lower than that of the liquid accommodation layer to the edge of the image formation region at which the image is scheduled to be formed. Then, the image is formed at the image formation region subjected to the pre-processing. Accordingly, a region having absorbability lower than that of the liquid accommodation layer is formed at the edge of the image on the recording medium. Thus, in post-processing, the region with the low absorbability is formed on the cut surface, even when the recording medium is cut for each image. Therefore, since moisture is prevented from infiltrating from the cut surface, the liquid acceptor can be prevented from being turbid.

Various kinds of recording media can be used. Accordingly, the recording medium may further include a transparent base layer. The liquid accommodation layer may be laminated on the base layer. In this case, a transparent liquid is suitable as the liquid to be landed to the recording medium in the pre-processing. Alternatively, the recording medium may further include a colored base layer and the liquid accommodation layer may be laminated on the base layer. In this case, a transparent liquid or a liquid with the same color as the base layer is suitable as the liquid to be landed to the recording medium in the pre-processing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
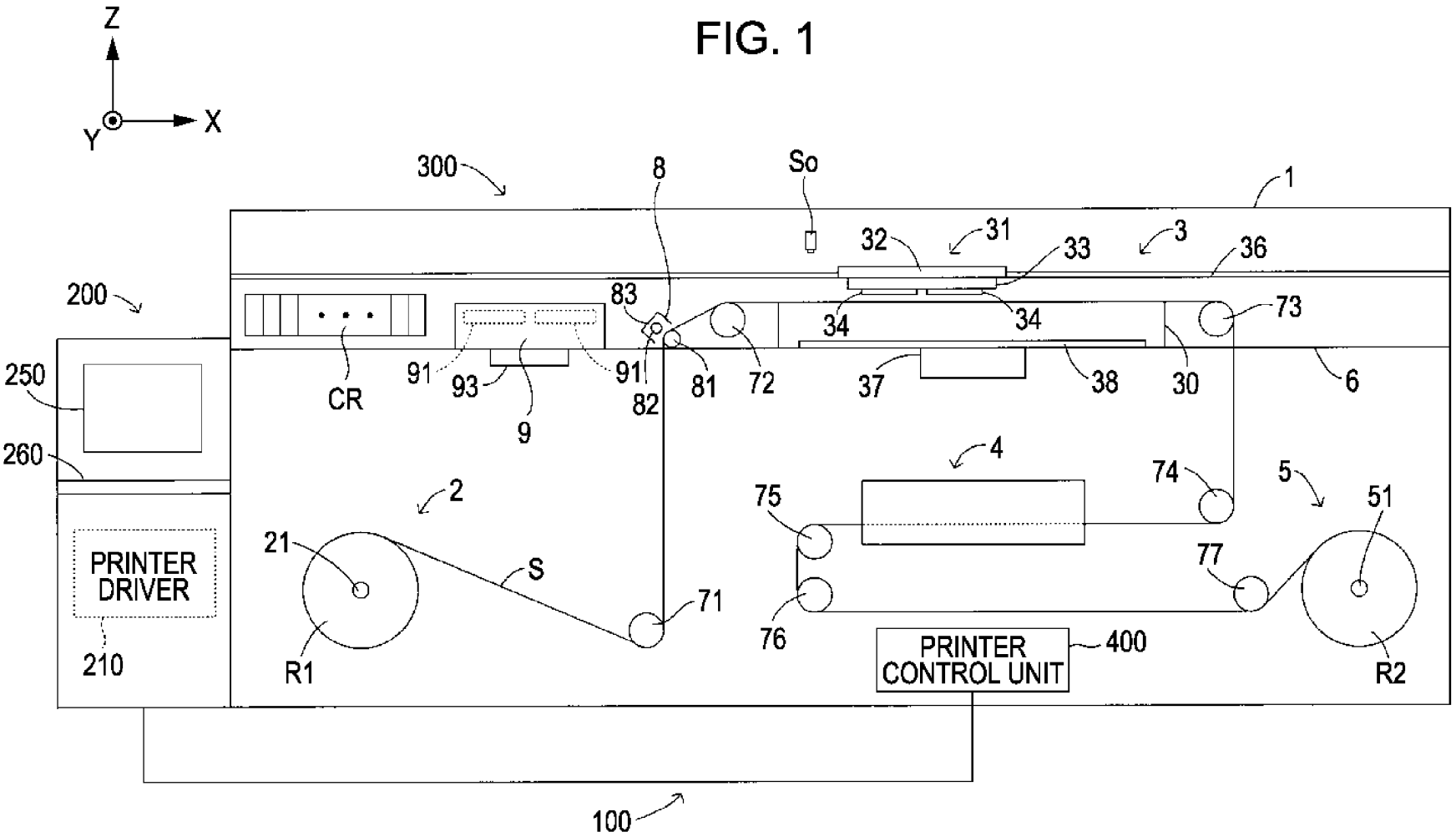
FIG. 1 is a schematic diagram illustrating an example of a printing system according to the invention.

FIG. 1 is a schematic diagram illustrating an example of a printing system according to the invention. In FIG. 1 and the drawings to be described below, XYZ orthogonal coordinates in which the Z axis serves as a vertical axis are written to clarify a disposition relation between apparatus units, as necessary. In the following description, a direction in which each coordinate axis (indicated by an arrow) is oriented is referred to as a positive direction and the opposite direction is referred to as a negative direction. The positive side of the Z axis is the upper side and the negative side of the Z axis is the lower side.

A printing system 100 includes a host apparatus 200 that generates print data based on image data received from an external apparatus such as a personal computer and a printer 300 that prints an image based on the print data received from the host apparatus 200. The printer 300 is a printer that prints an image on a sheet S in accordance with an ink jet method, while continuing to send the long sheet S wound in a roll shape.

As shown in FIG. 1, the printer 300 includes a body case 1 that has a substantially rectangular parallelepiped. An unreeling unit 2 that unreels the sheet S from a roll R1 around which the sheet S is wound, a printing chamber 3 that performs a printing process by ejecting ink to the continuously unreeled sheet S, a drying unit 4 that dries the sheet S to which the ink is attached, and a reeling unit 5 that reels the dried sheet S around a roll R2 are disposed inside the body case 1.

More specifically, the inside of the body case 1 is partitioned into the upper and lower parts in the Z-axis direction by a base plate 6 that has a flat plate shape and is disposed in parallel to the XY plane. The upper part of the base plate 6 is configured as the printing chamber 3. In the substantially middle of the printing chamber 3, a platen 30 is fixed to the upper surface of the base plate 6. The platen 30 has a rectangular shape, and thus the sheet S is supported from the lower side by the upper surface of the platen 30 parallel to the XY plane. Moreover, a recording unit 31 performs a printing process on the sheet S supported on the platen 30.

On the other hand, the unreeling unit 2, the drying unit 4, and the reeling unit 5 are disposed on the lower side of the base plate 6. The unreeling unit 2 is disposed on the lower side (the left lower inclined side of FIG. 1) of the platen 30 in an X-axis negative direction and has an unreeling shaft 21 that is rotatable. The sheet S is wound around the unreeling shaft 21, and thus the roll R1 is supported. On the other hand, the reeling unit 5 is disposed on the lower side (right lower inclined side of FIG. 1) of the platen 30 in the X-axis positive direction and has a reeling shaft 51 that is rotatable. The sheet S is wound around the reeling shaft 51, and thus the roll R2 is supported. Between the unreeling unit 2 and the reeling unit 5 in the X-axis direction, the drying unit 4 is disposed immediately below the platen 30. Further, the drying unit 4 is disposed on the slight upper side from the unreeling unit 2 and the reeling unit 5.

The sheet S transported from the unreeling unit 2 to the reeling unit 5 sequentially passes through the printing chamber 3 and the drying unit 4, while being guided by seven rollers 71 to 77. That is, the roller 71 is disposed in the X-axis positive direction of the unreeling shaft 21 of the unreeling unit 2. Therefore, the sheet S unreeled in the X-axis positive direction from the unreeling shaft 21 is guided upward, while being wound around the roller 71.

On the upper side of the roller 71 and inside the printing chamber 3, an earth electrode roller 81 of a corona processor 8 to be described below and the two rollers 72 and 73 are arranged in this order in the X-axis positive direction. The earth electrode roller 81 is disposed on the slight lower side from the two rollers 72 and 73. Therefore, the sheet S guided upward from the roller 71 is wound around the earth electrode roller 81, and then is wound around the two rollers 72 and 73 after the direction of the sheet S is changed upward in an inclination direction.

The rollers 72 and 73 are disposed with the platen 30 interposed therebetween so as to be lined up straight in parallel (that is, horizontal) in the X-axis direction. The positions of the rollers 72 and 73 are adjusted so that the heights of the top parts of the rollers 72 and 73 are the same as the height of the upper surface (which is a surface supporting the sheet S) of the platen 30. Accordingly, the sheet S wound around the roller 72 is moved horizontally (in X-axis direction) while coming into contact with the upper surface of the platen 30, until the sheet S reaches the roller 73. Then, the sheet S wound around the roller 73 is guided downward.

On the lower side (the lower side of the base plate 6) of the roller 73, the two rollers 74 and 75 are arranged in this order in the X-axis negative direction. The sheet S wound around the rollers 74 and 75 is guided in parallel (that is, horizontally) in the X-axis direction between the rollers 74 and 75. Further, the drying unit 4 is disposed between the rollers 74 and 75. Accordingly, the direction of the sheet S wound around the roller 74 is changed in the X-axis negative direction, and the sheet S passes through the inside of the drying unit 4 until the sheet S reaches the roller 75.

On the lower side of the roller 75, the two rollers 76 and 77 are arranged in this order in the X-axis positive direction. The direction of the sheet S wound around the roller 76 is changed in the X-axis positive direction, and the sheet S reaches the roller 77. Then, the sheet S wound around the roller 77 is wound around the reeling shaft 51 of the reeling unit 5 disposed in the X-axis positive direction of the roller 77.

Thus, the sheet S unreeled from the unreeling unit 2 passes through the printing chamber 3 and the drying unit 4, and then is wound around the reeling unit 5. Then, the sheet S is subjected to the printing process of the printing chamber 3 and a drying process of the drying unit 4.

In the printing chamber 3, the printing process is performed by the recording unit 31 that is disposed on the upper side of the platen 30. The recording unit 31 performs the printing process by ejecting, to the sheet S, ink supplied by an ink supplying mechanism (not shown) from ink cartridges CR disposed at the end portion (the left end portion in FIG. 1) in the X-axis negative direction in the printing chamber 3 in accordance with the ink jet method. Specifically, the recording unit 31 includes a carriage 32, a plate-shaped supporting plate 33 mounted on the lower surface of the carriage 32, and a plurality of recording heads 34 mounted on the lower surface of the supporting plate 33.

Figure 2:
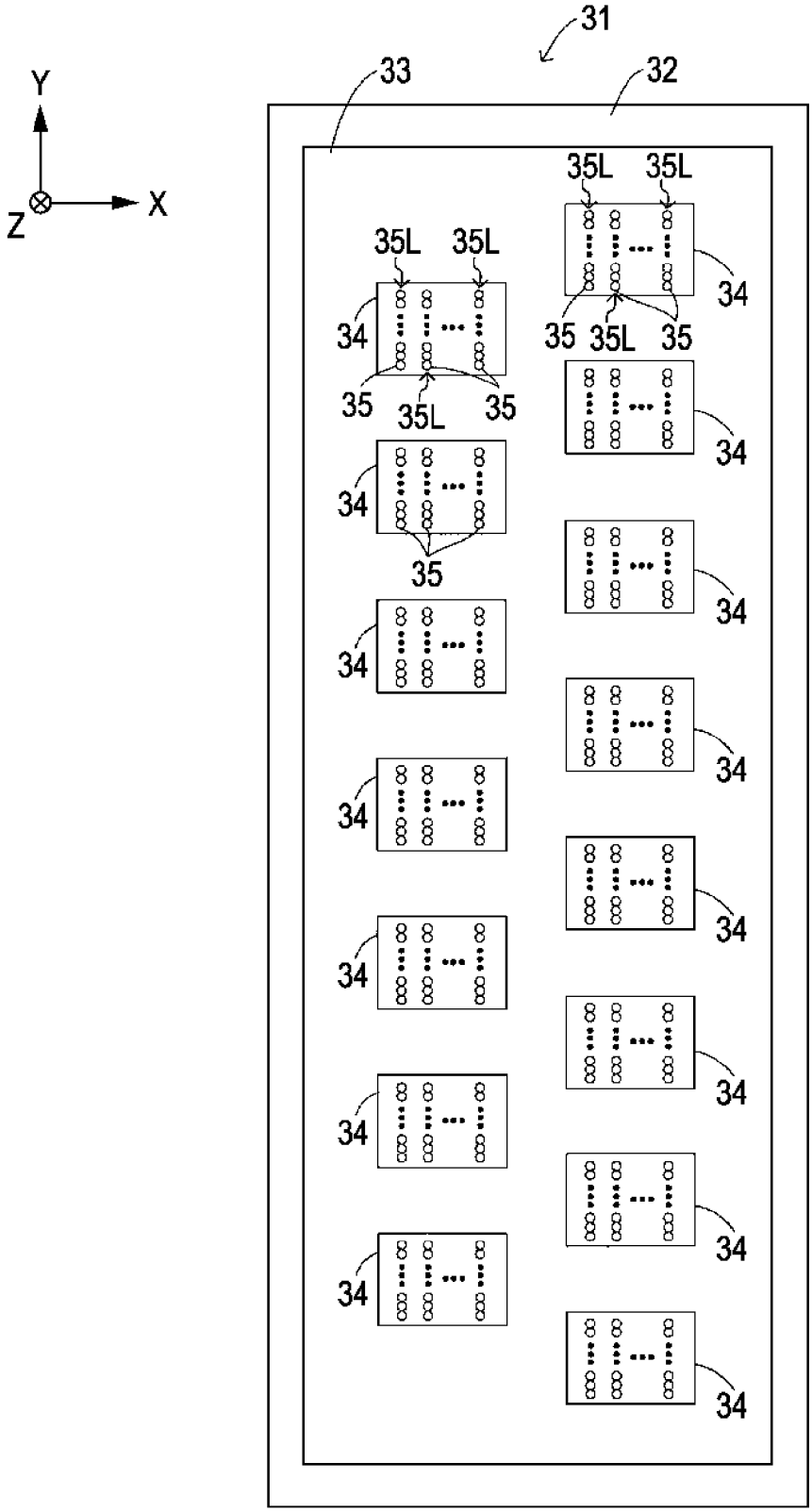
FIG. 2 is a plan view partially illustrating the configuration of a recording unit.

FIG. 2 is a plan view partially illustrating the configuration of the recording unit. As shown in FIG. 2, fifteen recording heads 34 are arranged in two lines in a zigzag form at the same pitch in the Y-axis direction on the lower surface of the supporting plate 33. The recording heads 34 eject ink from nozzles 35 and have the same configuration. Hereinafter, the configuration of one representative recording head 34 will be described in detail.

On the lower surface of the recording head 34, the plurality (for example, 180) of nozzles 35 are arranged at the same pitch in a straight line in the Y-axis direction to form one nozzle line 35L and the plurality of nozzle lines 35L are arranged at the same pitch in the X-axis direction. Each nozzle 35 operates in accordance with a piezoelectric method of applying a voltage to a piezoelectric element mounted on a minute pipe filled with ink to deform the piezoelectric element and ejecting ink out of the tube.

Thus, the plurality of nozzle lines 35L lined up in parallel on the lower surface of the recording head 34 correspond to different ink colors, respectively. For example, when eight colors of ink is used, eight nozzle lines 35L are lined up in parallel on the lower surface of the recording head 34. The nozzles 35 belonging to the same nozzle line 35L eject ink of the same color and the nozzles 35 belonging to the different nozzle lines 35L eject ink of different colors.

In this embodiment, a nozzle line 35L ejecting an OP (overprinting) liquid for overprinting is separately formed. The OP liquid is ink that does not substantially contain a color material and has the same property as resin ink. Here, the phase "the ink does not substantially contain a color material" means that a sufficient amount of color material to exhibit a color is intentionally not mixed. For example, the content of the color material contained in ink is less than 0.05 mass %, is more preferably less than 0.01 mass %, is even more preferably less than 0.005 mass %, and is most preferably less than 0.001 mass %. The OP liquid is supplied from the ink cartridge CR to the recording heads 34, as in the other colored ink. Moreover, the OP ink contains a thermoplastic resin. Any thermoplastic resin can be used within a range in which a liquid droplet of an ink composition can be ejected in accordance with an ink jet printing method. For example, a single of an (meta) acrylic resin, a styrene acrylic resin, a rosin-modified resin, a phenol resin, a terpene-based resin, a polyester resin, a polyamide resin, an epoxy resin, a vinyl chloride-vinyl acetate copolymer resin, a cellulose-based resin such as cellulose acetate butyrate, and a vinyl toluene-α-methylstyrene copolymer resin or a copolymer thereof can be used as the thermoplastic resin. A mixture of these resin may be used as a first thermoplastic resin. Of the exemplified resins, an (meta) acrylic resin, that is, an acrylic resin or a methacrylic resin is preferably used as the thermoplastic resin. A single methyl methacrylate polymer or a copolymer of methyl methacrylate and butyl methacrylate is more preferably used.

Referring back to FIG. 1, the description will be continued. The carriage 32 of the recording unit 31 having the above-described configuration is configured to be movable integrally with the supporting plate 33 and the recording heads 34. Specifically, a first guide rail 36 extending in the X-axis direction is installed in the printing chamber 3. When the carriage 32 receives a driving force of a first CR motor Mx (see FIG. 3), the carriage 32 is moved along the first guide rail 36 in the X-axis direction. Further, a second guide rail (not shown) extending in the Y-axis direction is installed in the printing chamber 3. When the carriage 32 receives a driving force of a second CR motor My (see FIG. 3), the carriage 32 is moved along the second guide rail in the Y-axis direction.

The printing process is performed by moving carriage 32 of the recording unit 31 two-dimensionally in the XY plane with respect to the sheet S stopped on the upper surface of the platen 30. Specifically, the recording unit 31 performs a process (main scanning process) of ejecting the ink to the sheet S from the nozzles 35 of the recording heads 34, while the carriage 32 is moved in the X-axis direction (main scanning direction). In the main scanning process, a plurality of one-line images (line images), each of which is formed with the ink ejected from one nozzle and extends in the X-axis direction, are lined up in parallel while keeping an interval in the Y-axis direction, and thus a two-dimensional image is printed. The main scanning process and a sub-scanning process of moving the carriage 32 in the Y-axis direction (sub-scanning direction) are alternately performed, and thus the main scanning process is performed a plurality of times (lateral scanning method).

That is, when the main scanning process is completed once, the recording unit 31 moves the carriage 32 in the Y-axis direction by performing the sub-scanning process. Next, the recording unit 31 moves the carriage 32 in the X-axis direction (which is the opposite direction to the earlier main scanning direction) from the position to which the carriage 32 is moved through the sub-scanning process. Thus, the line images are formed through the new main scanning process between the line images already formed through the earlier main scanning process. Then, the main scanning process and the sub-scanning process are alternately performed. That is, in the printer 300, a process (the main scanning process) of forming an intermediately formed image including the plurality of line images by ejecting the ink from the nozzles 35, while moving the carriage 32 in the X-axis direction is performed a plurality of times while changing the position of the carriage 32 in the Y-axis direction (performing the sub-scanning process), so that the intermediately formed images overlap each other to form an image.

Thus, the printing process is performed once by performing the main scanning process the plurality of times. Here, the main scanning process performed once is referred to as "pass" and the printing process performed once by performing the pass a plurality of times is referred to as "frame." Further, the intermediately formed image formed on the sheet S through one-time pass is referred to as "one-pass image."

The reason for alternately performing the main scanning process and the sub-scanning process repeatedly is to improve a resolution. That is, when the pass is performed M times and M one-pass images overlap each other, an image corresponding to one frame having a resolution which is M multiples of the resolution of the one-pass image can be obtained. Therefore, the recording unit 31 performs a one-frame printing process by performing the pass a number of times corresponding to the resolution of an image to be printed.

The carriage 32 can reciprocate in the X-axis direction. Therefore, the recording unit 31 efficiently performs the pass a plurality of times by performing the pass in the forward and backward directions of the carriage 32.

The one-frame printing process described above is repeatedly performed while the sheet S is intermittently moved in the X-axis direction. Specifically, a predetermined range which includes substantially the entire region of the upper surface of the platen 30 is a print region. The sheet S is intermittently transported in the X-axis direction using a distance (intermittent transport distance) corresponding to the length of the print region in the X-axis direction as a unit, and the one-frame printing process is performed on the sheet S stopped on the upper surface of the platen 30 during the intermittent transport. Specifically, when the one-frame printing process is completed on the sheet S stopped on the platen 30, the sheet S is transported only by the intermittent transport distance in the X-axis direction and a non-printed surface of the sheet S is stopped on the platen 30. Next, when the one-frame printing process is newly performed on the non-printed surface and ends, the sheet S is transported again only by the intermittent transport distance in the X-axis direction. In this way, the series of processes is repeatedly performed.

Since the sheet S stopped on the upper surface of the platen 30 during the intermittent transport is flatly supported, the platen 30 includes a mechanism that suctions the sheet S stopped on the upper surface. Specifically, a plurality of suction holes (not shown) are opened on the upper surface of the platen 30 and a suction unit 37 is mounted on the lower surface of the platen 30. When the suction unit 37 operates, the negative pressure is generated in the suction holes of the upper surface of the platen 30 and the sheet S is suctioned to the upper surface of the platen 30. The suction unit 37 suctions the sheet S while the sheet S is stopped on the platen 30 to perform the printing process. Then, the sheet S is suctioned and thus is supported flatly. On the other hand, when the printing process ends, the suctioning of the sheet S is stopped, and thus the sheet S can be transported smoothly.

A heater 38 is mounted on the lower surface of the platen 30. The heater 38 is a unit that heats the platen 30 to a predetermined temperature (for example, 45 degrees). Thus, the sheet S is subjected to the printing process by the recording heads 34 and is subjected to a primary drying process by the heat of the platen 30. Thus, the ink landed on the sheet S is dried rapidly through the primary drying process.

Thus, the sheet S subjected to the one-frame printing process and the primary drying process on the upper surface of the platen 30 is moved with the intermittent transport of the sheet S and reaches the drying unit 4. The drying unit 4 performs a drying process of completely drying the ink landed on the sheet S using air heated for dryness. Then, the sheet S subjected to the drying process reaches the reeling unit 5 with the intermittent transport of the sheet S and is wound around the roll R2.

In this way, the recording unit 31 and the drying unit 4 perform the printing and drying processes on the sheet S, respectively. The printer 300 includes functional units such as the corona processor 8 and a maintenance unit 9 as well as the recording unit 31 and the drying unit 4 described above. Next, the configurations and operations of the corona processor 8 and the maintenance unit 9 will be described in detail.

The corona processor 8 is disposed on the upstream side of the platen 30 in the transport direction of the sheet S and reforms the surface of the sheet S before the sheet S enters the platen 30. Specifically, the corona processor 8 includes an earth electrode roller 81 that winds the sheet S on the upstream side of the roller 72 in the transport direction of the sheet S, a corona discharge electrode 82 that faces the earth electrode roller 81 with the sheet S interposed therebetween, and an electrode cover 83 that covers the corona discharge electrode 82. The corona discharge electrode 82 receives an application of a discharge bias from a discharge bias generation unit 84 (see FIG. 3) and generates corona discharge between the corona discharge electrode 82 and the earth electrode roller 81. The surface of the sheet S is reformed through the corona discharge, and thus the wettability of the sheet S with respect to the ink is improved. When the surface of the sheet S is reformed before the printing process, the fixing property of the ink to the sheet S in the printing process can be improved.

The maintenance unit 9 is disposed at a position deviated from the platen 30 in the X-axis negative direction and performs a maintenance process on the recording heads 34 evacuated to a home position (a position immediately above the maintenance unit) when no printing process is performed. The maintenance unit 9 includes fifteen caps 91 installed to have a one-to-one relation with the fifteen recording heads 34 and an elevation unit 93 that moves up and down the caps 91.

Examples of the maintenance process performed by the maintenance unit 9 include a capping process, a cleaning process, and a wiping process. The capping process is a process of causing the elevation unit 93 to move up the caps 91 and covering the recording heads 34 located at the home position with the caps 91. The viscosity of the ink can be prevented from increasing in the nozzles 35 of the recording heads 34 through the capping process. The cleaning process is a process of generating a negative pressure in the caps 91 when the recording heads 34 are capped and forcibly discharging the ink from the nozzles 35. The thickened ink, bubbles in the ink, or the like can be removed from the nozzles 35 through the cleaning process. The wiping process is a process of wiping the surface (nozzle-opening formation surface) on which the openings of the nozzles 35 are lined up in parallel in the recording heads 34 using a wiper (not shown). The ink can be wiped from the nozzle-opening formation surfaces of the recording heads 34 through the wiping process.

Figure 3:
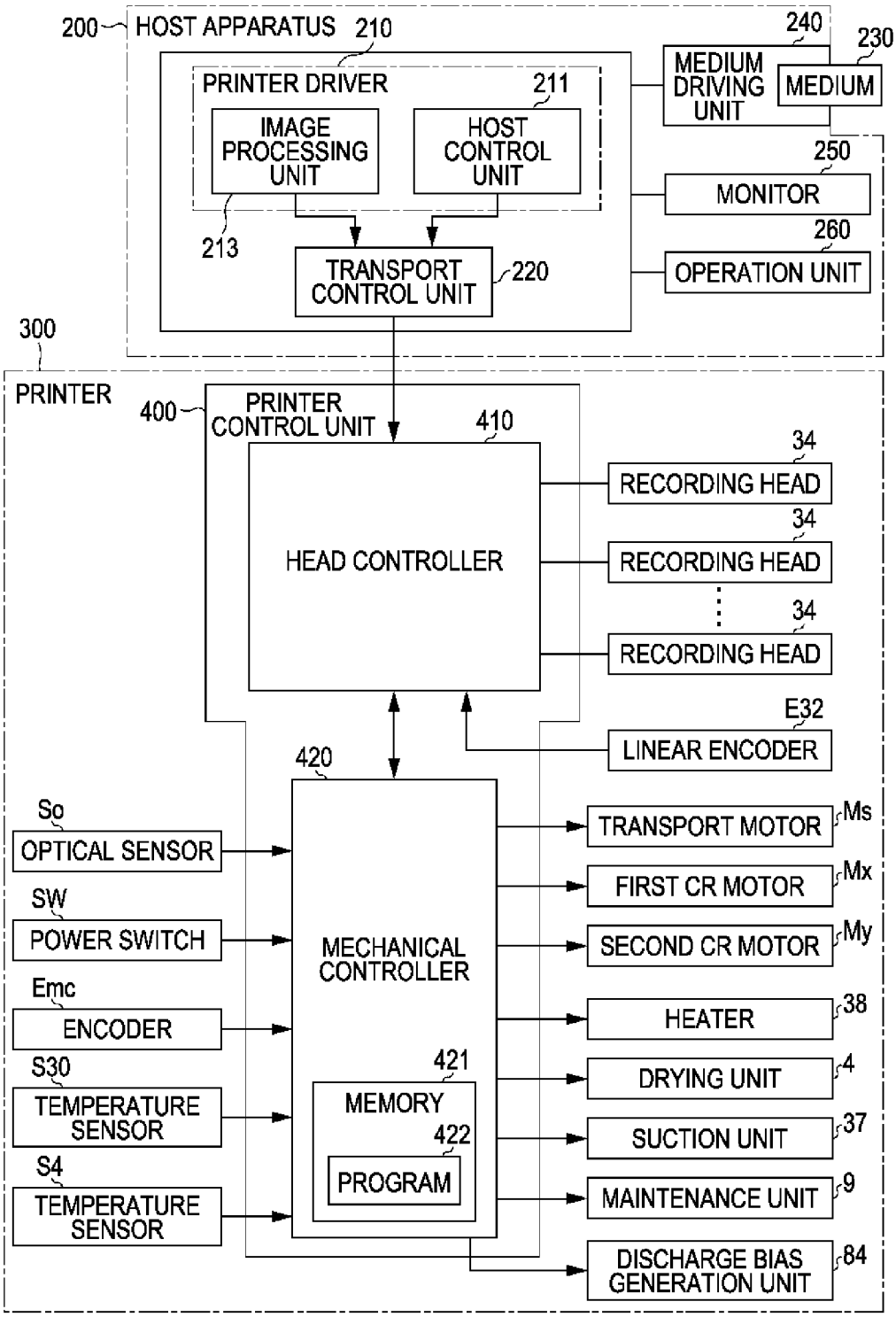
FIG. 3 is a block diagram schematically illustrating an electrical configuration of the printing system in FIG. 1.

An overview of the apparatus configuration of the printing system 100 has been described. Next, an electrical configuration of the printing system in FIG. 1 will be described in detail with reference to FIG. 3 in addition to FIG. 1 described above. Here, FIG. 3 is a block diagram schematically illustrating the electrical configuration of the printing system in FIG. 1.

As described above, the printing system 100 includes the host apparatus 200 controlling the printing system 100 as well as the printer 300. The host apparatus 200 is configured by, for example, a personal computer. The host apparatus 200 has a printer driver 210 that controls the processes of the printer 300 therein. The host apparatus 200 also includes a transport control unit 220 that has a communication function to communicate with the printer 300. The printer driver 210 is constructed by causing a CPU (Central Processing Unit) of the host apparatus 200 to execute a program for the printer driver 210.

The host apparatus 200 includes a medium driving unit 240 that accesses a medium 230 storing the program for the printer driver and reads the program. Various kinds of media such as a CD (Compact Disc), a DVD (Digital Versatile Disc), and a USB (Universal Serial Bus) memory can be used as the medium 230.

The host apparatus 200 further includes a monitor 250 configured by a liquid crystal display or the like and an operation unit 260 configured by a keyboard, a mouse, or the like as interfaces with a worker. Further, the operation unit 260 may be configured by a touch panel of the monitor 250 using a touch panel type display as the monitor 250. A menu screen is displayed in addition to an image to be printed on the monitor 250. Accordingly, the worker can open a print setting screen from the menu screen by operating the operation unit 260 while viewing the monitor 250 and can set various printing conditions such as kinds of print media, the size of the print media, printing qualities, and the number of printings.

The print media (that is, the sheets S) are classified broadly into sheet-based media and film-based media. Specifically, examples of the sheet-based media include a high-quality sheet, a cast sheet, an art sheet, and a coat sheet and examples of the film-based media include a PET (polyethylene terephthalate) and PP (polypropylene). The width (width in the Y-axis direction) of the sheet S is set as the size of the print medium. The print quality can be set by selecting one print mode from a plurality of print modes prepared in accordance with print resolutions. For example, the print quality can be selected as follows. That is, in the printer 300, the resolution can be changed by changing the number of passes performed in one frame. Accordingly, a plurality of print modes in which the numbers of passes performed in one frame are different may be prepared and a print mode with the number of passes corresponding to a resolution to be used in the printing process may be selected. Thus, the printing process can be performed with the resolution corresponding to the number of passes of the selected print mode. Further, the print quality may be set by directly inputting the resolution instead of the print mode. The number of printings is set when a plurality of printings (images) are printed in the same area of the print medium in an overlapping manner. Specifically, the number of printings to be printed in the overlapping manner is set. When the plurality of printings are set, the image of each printing can be displayed on the monitor 250.

The printer driver 210 includes a display of the monitor 250 described above and a host control unit 211 that controls an inputting process from the operation unit 260. That is, the host control unit 211 displays various kinds of screens such as a menu screen and a print setting screen on the monitor 250 and performs a process suitable for the content input from the operation unit 260 on the various kinds of screens. Thus, the host control unit 211 generates a control signal necessary for controlling the printer 300 in accordance with an input from the worker.

The printer driver 210 includes an image processing unit 213 that performs image processing on image data received from an external apparatus and generates print data. Specifically, the image processing such as a resolution conversion process, a color conversion process, and a halftone process is performed.

The control signal generated by the host control unit 211 and the print data generated by the image processing unit 213 are transmitted to a printer control unit 400 installed in the body case 1 of the printer 300 via the transmission control unit 220. The transmission control unit 220 can perform bidirectional serial communication with the printer control unit 400. Therefore, the transmission control unit 220 transmits the control signal and the print data to the printer control unit 400, receives response signals of the control signal and the print data from the printer control unit 400, and transmits the received response signals to the host control unit 211.

The printer control unit 400 includes a head controller 410 and a mechanical controller 420. The head controller 410 has a function of controlling the recording heads 34 based on the print data transmitted from the printer driver 210. Specifically, the head controller 410 controls the ejection of the ink from the nozzles 35 of the recording heads 34 based on the print data. At this time, an ejection timing of the ink from the nozzles 35 is controlled based on the movement of the carriage 32 in the X-axis direction. That is, a linear encoder E32 that detects the position of the carriage 32 in the X-axis direction is installed in the printing chamber 3. Further, the head controller 410 ejects the ink from the nozzles 35 at a timing corresponding to the movement of the carriage 32 in the X-axis direction with reference to the output of the linear encoder E32.

On the other hand, the mechanical controller 420 mainly performs a function of controlling the intermittent transport of the sheet S and the driving of the carriage 32. Specifically, the mechanical controller 420 controls a transport motor Ms, which drives a sheet transport system configured by the unreeling unit 2, the rollers 71 to 77, and the reeling unit 5, based on the output of an encoder Emc, which detects rotation of the transport motor Ms, and performs the intermittent transport of the sheet S. Further, the mechanical controller 420 causes the carriage 32 to perform movement in the X-axis direction through the main scanning process by controlling the first CR motor Mx and causes the carriage 32 to perform movement in the Y-axis direction through the sub-scanning process by controlling the second CR motor Mx.

By synchronizing the head controller 410 and the mechanical controller 420 with each other and performing these controls appropriately, the passes are performed on the intermittently transported sheet S by the number of times corresponding to the resolution, and thus the printing process corresponding to one frame is performed. Thus, an image corresponding to one frame with the desired resolution is printed on the sheet S.

The mechanical controller 420 can perform various kinds of controls as well as the above-decried controls for the printing process. Specifically, the mechanical controller 420 detects ON/OFF of a power switch SW. When the power switch SW is turned on, the mechanical controller 420 performs a process of starting each unit of the printer 300. The mechanical controller 420 performs feedback control of the heater 38 based on the output of a temperature sensor S30 that detects the temperature of the upper surface of the platen 30 or performs temperature control such as feedback control of the drying unit 4 based on the output of a temperature sensor S4 that detects the internal temperature of the drying unit 4. The mechanical controller 420 can perform various processes. For example, the mechanical controller 420 adjusts the negative pressure generated in the suction holes of the platen 30 by controlling the suction unit 37, performs predetermined maintenance by controlling the maintenance unit 9, and adjust a discharge bias value by controlling the discharge bias generation unit 84.

Figure 4:
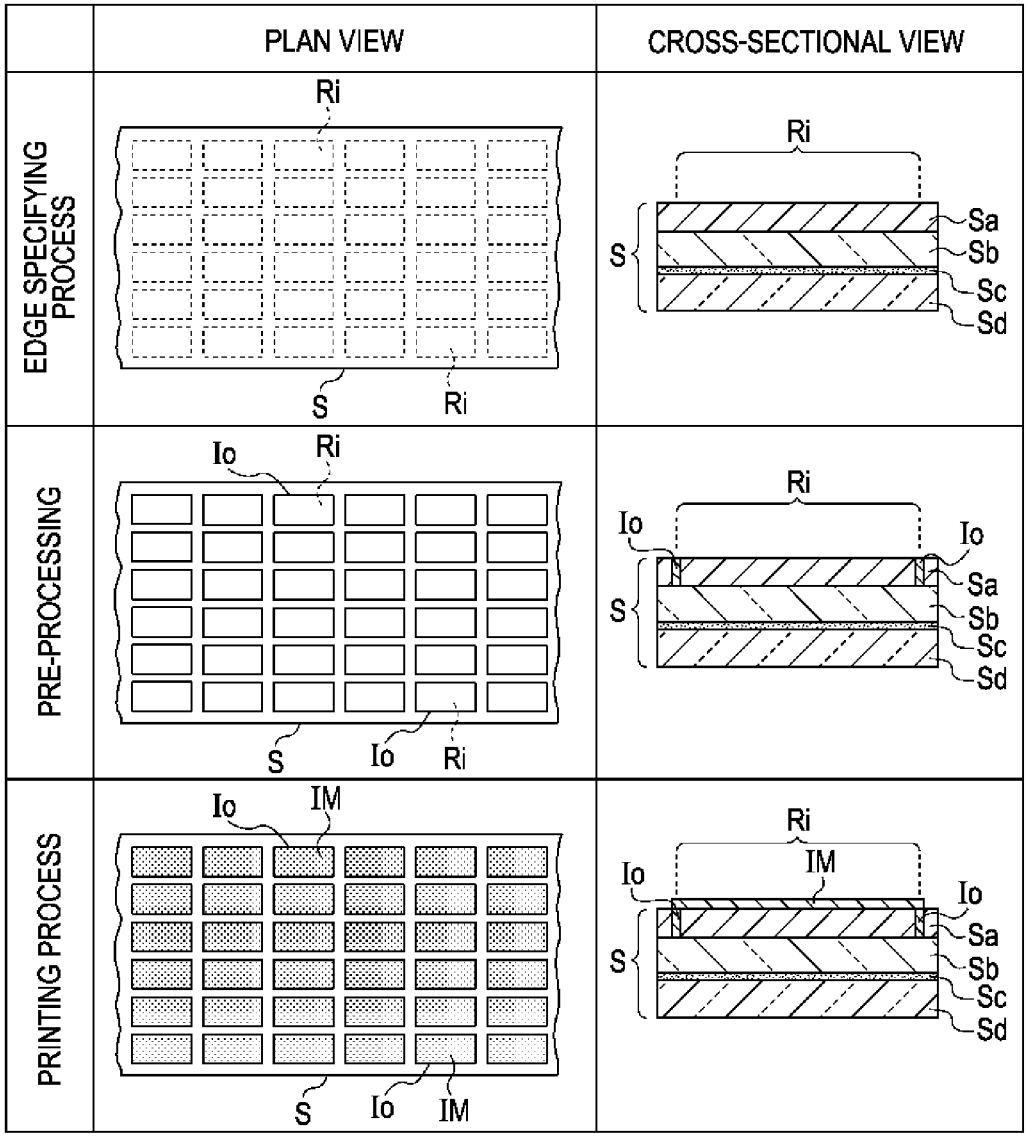
FIG. 4 is a schematic diagram illustrating an example of a printing process executed by the printing system in FIG. 1.

The overview of the electrical configuration of the printing system in FIG. 1 has been described. Next, an example of the printing process performed by the printing system will be described in detail with reference to FIG. 4. Here, FIG. 4 is a schematic diagram illustrating an example of the printing process performed by the printing system in FIG. 1. In FIG. 4, a plan view illustrating an operation of each process is shown on the left side and a cross-sectional view illustrating an operation of each process is shown on the right side.

As shown in a section of the "printing process" of the "plan view" on the left side of the drawing, a plurality of label images IM are printed (imposed) in a print region of the sheet S supported on the platen 30 in the sheet S during the intermittent stop in the example of the drawing. Further, as shown in a section of the "printing process" of the "cross-sectional view" on the right side of the drawing, the sheet S to be subjected to the printing process has a lamination structure in the example of the drawing. Specifically, the sheet S has a configuration in which an ink accommodation layer Sa is laminated on one surface of a film-shaped transparent base layer Sb and a seal Sd is attached to the other surface of the base layer Sb with an adhesive layer Sc interposed therebetween. The ink accommodation layer Sa, the adhesive layer Sc, and the seal Sd are all transparent. Further, the ink accommodation layer Sa can be formed by porous inorganic particles such as alumina or silica and a binder formed of a water-soluble resin.

The mechanical controller 420 controls each unit of the printer 300 in accordance with a program 422 stored in an internal memory 421 and performs a series of processes shown in the drawing. The program 422 is read from the medium 230 via the printer driver 210 and is stored in a memory of the mechanical controller 420 (see FIG. 3).

Before the printing process, the mechanical controller 420 calculates each image formation region Ri in which each label image IM is scheduled to be formed through the printing process. Specifically, the mechanical controller 420 analyzes the print data transmitted from the host apparatus 200 to the printer control unit 400 and calculates each image formation region Ri. Further, the mechanical controller 420 specifies the position of the periphery of each image formation region Ri (edge specifying process).

Further, when a post-processing machine cuts a label, data regarding a cut line set in the periphery of a label image to be cut is sometimes used. When the above-described image data includes the data regarding the cut line, the image formation region Ri may be specified based on the data regarding the cut line.

When the position of the periphery of each image formation region Ri is specified through the edge specifying process, the mechanical controller 420 ejects an OP liquid Io from the recording heads 43 toward the sheet S intermittently stopped on the platen 30 to apply the OP liquid Io to the periphery of each image formation region Ri in cooperation with the head controller 410 (pre-processing). At this time, as shown in the section of the "cross-sectional view" of the "pre-processing" of FIG. 4, a sufficient amount of OP liquid Io is preferably applied so that the OP liquid Io applied to the periphery of each image formation region Ri can infiltrate into the entire thickness of the ink accommodation layer Sa.

When the pre-processing is completed, the mechanical controller 420 performs the one-frame printing process in cooperation with the head controller 410 to print the label image IM inside each of the plurality of image formation regions Ri (printing process). When the printing process ends, the sheet S is intermittently transported. Then, the edge specifying process, the pre-processing, and the printing process are performed on a new surface of the sheet S. These operations are repeated while the sheet S is intermittently transported, and the sheet S on which the label images IM are printed is wound around the roll R2.

In this way, the roll R2 winding the sheet S on which the label images IM are printed is taken out from the printer 300 by the worker. Then, post-processing such as a laminating process and a cutting process is performed in an apparatus different from the printer 300. An apparatus according to the related art can be used as that performs the post-processing. For example, the apparatus disclosed in JP-A-2006-213035 can be used. Further, the printer 300 may have a function of the post-processing such as the laminating process and/or the cutting process. In this case, the cutting process may be performed by a method of cutting the label from the print medium at the region of the liquid accommodation layer including a liquid that contains a material with absorbability lower than that of the liquid accommodation layer based on the periphery of the specified image formation region Ri or the data regarding the cut line included in the print data. Next, the laminating process and the cutting process performed as the post-processing will be described in detail.

Figure 5:
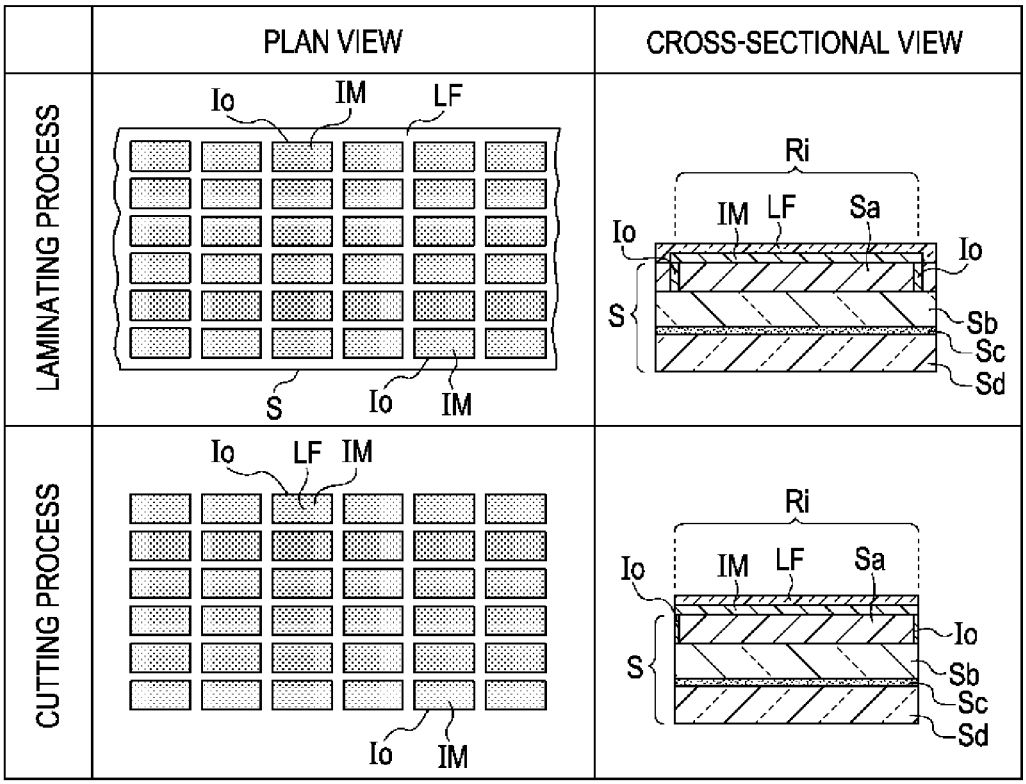
FIG. 5 is a schematic diagram illustrating examples of a laminating process and a cutting process.

FIG. 5 is a schematic diagram illustrating examples of the laminating process and the cutting process. In the laminating process shown in FIG. 5, a transparent lamination film LF is attached to the entire surface of the sheet S closer to the ink accommodation layer Sa by a transparent adhesive. Thus, the ink accommodation layer Sa is covered with the lamination film LF to be protected. The laminating process may be performed by applying a transparent lamination liquid to the entire surface of the sheet S closer to the ink accommodation layer Sa, instead of the lamination film.

When the laminating process is completed, the cutting process is performed to cut the sheet S for each label image IM. That is, the sheet S is cut along the periphery of each label image IM. Further, as described above, the OP liquid Io is applied to the periphery of each label image IM by performing the pre-processing. Accordingly, a region (in other words, a region in which the material contained in the OP liquid Io remains and is attached) into which the OP liquid Io infiltrates is formed in the ink accommodation layer Sa in the periphery of the label image IM. Accordingly, as shown in the section of the "cross-sectional view" of the "cutting process" of FIG. 5, the region into which the OP liquid Io infiltrates is shown in the cut surface of the sheet S. In other words, the cuts surface of the ink accommodation layer Sa is coated with the OP liquid Io.

When each label image IM cut in this way is attached to a product or the like, the seal Sd may be removed and the exposed adhesive layer Sc may be attached to the product or the like. Further, since the base layer Sb of the sheet S is transparent, the label image IM can be viewed from the side of the adhesive layer Sc of the sheet S. Therefore, when the label image IM is attached to a product or the like, the label image IM may be attached so that the label image IM can be viewed from the side of the adhesive layer Sc of the sheet S.

In this embodiment, as described above, the pre-processing is performed by landing the OP liquid Io containing the material that has the absorbability lower than that of the ink accommodation layer Sa to the edge of the image formation region Ri in which the label image IM is scheduled to be formed. Then, the label image IM is formed in the image formation region Ri subjected to the pre-processing. Accordingly, the region (the region into which the OP liquid Io infiltrates in FIG. 4) having the absorbability lower than that of the ink accommodation layer Sa is formed in the edge of the label image IM on the sheet S. Thus, even when the sheet S is cut for each label image IM in the post-processing, moisture is prevented from infiltrating from the cut surface due to the fact that the region having the low absorbability is formed in the cut surface. Therefore, the ink acceptor can be prevented from being turbid (white turbid).

Other Embodiments

In the above-described embodiment, the printer 300 corresponds to an "image recording apparatus" of the invention, the program 422 corresponds to a "program" of the invention, the medium 230 corresponds to a "program recording medium" of the invention, the mechanical controller 420 corresponds to a "computer" of the invention, the pre-processing corresponds to "performing pre-processing" of the invention, and the printing process corresponds to "forming the image at the image formation region" of the invention. Further, the sheet S corresponds to a "recording medium" of the invention, the ink accommodation layer Sa corresponds to a "liquid accommodation layer" of the invention, and the base layer Sb corresponds to a "base layer" of the invention.

The invention is not limited to the above-described embodiment, but may be modified in various forms from the above-described embodiment without departing from the gist of the invention. For example, in the above-described embodiment, the OP liquid Io is applied to the edge of the image formation region Ri so that the OP liquid Io can infiltrate into the entire thickness of the ink accommodation layer Sa in the pre-processing. However, the OP liquid Io may not necessarily infiltrate into the entire thickness of the ink accommodation layer Sa. That is, even when the OP liquid Io may infiltrate into the halfway of the thickness of the ink accommodation layer Sa, the function of preventing moisture from infiltrating from the cut surface can be realized in the portion into which the OP liquid Io infiltrates.

In the above-described embodiment, the OP liquid Io has been edged around the periphery of the image formation region Ri (in other words, the OP liquid Io is applied only to the periphery of the image formation region Ri). However, the OP liquid Io may be applied to the entire surface of the image formation region Ri including the periphery.

In the above-described embodiment, a film-based sheet using the film-shaped transparent base layer Sb has been used as the sheet S. However, the invention may be applied when an image is recorded on the sheet S using a colored base layer Sb. In this case, in the pre-processing, ink with the same color as the base layer Sb may be used as the liquid applied to the periphery of the image formation region Ri, as well as the above-described transparent OP ink. Specifically, for example, when a white sheet S in which a transparent ink accommodation layer Sa is formed on a white base layer Sb, the above-described pre-processing can be performed using the white ink.

A white-based colorant forming the white ink is a colorant that can be used to record a color called "white" in light of common sense and includes a colorant with a slight amount of white. Further, ink containing this colorant includes a colorant called in the name of "white ink." Further, when the ink containing the colorant is recorded on the EPSON pure photo sheet <gloss> (made by Seiko Epson Corp.), a colorant that has lightness (L*) and chromaticity (a*, b*) falling within the ranges of $70 \leq L^* \leq 100$, $-4.5 \leq a^* \leq 2$, and $-6 \leq b^* \leq 2.5$ is included when the lightness and the chromaticity are measured using the spectroscopic photometer Spectrolino (product name made by GretagMacbeth Co., Ltd) by setting measurement conditions of a D50 light source, a measurement visual field of 2°, a density of DIN NB, a whiter reference of Abs, no filter, and a measurement mode of reflectance.

Examples of the white-based colorant include metal oxide particles such as titanium dioxide, zinc oxide, silica, alumina, magnesium oxide, zirconium oxide or particulars having hollow structure. Of these particles, titanium dioxide particles produced in the form of titanium dioxide powder are preferably used from the viewpoint of the degree of whiteness being excellent.

The white ink is applied to the periphery of the label image IM by performing the pre-processing using white ink. Accordingly, a region (in other words, a region in which a material contained in the white ink remains and is attached) into which the white ink infiltrates is formed in the ink accommodation layer Sa in the periphery of the label image IM. Accordingly, when the cutting process is performed in the post-processing, the region into which the white ink infiltrates is shown on the cut surface of the sheet S. In other words, the cut surface of the ink accommodation layer Sa is coated with the white ink. Thus, moisture is prevented from infiltrating from the cut surface, and the ink acceptor can be prevented from being turbid (white turbid).

In the above-described embodiment, the sheet S including the adhesive layer Sc and the seal Sd has been used. However, the sheet S that can be used in the invention is not limited thereto. A sheet S that does not include the adhesive layer Sc and the seal Sd may be used.

In the above-described embodiment, an external apparatus of the printer 300 has performed the post-processing (the laminating process and the cutting process). However, a device that perform some (the laminating process) or all (the laminating process and the cutting process) of the post-processing may be included in the printer 300.

In the above-described embodiment, the ink jet type printer 300 has been used as an image recording apparatus. However, a fluid ejecting apparatus that spraying or ejecting a fluid other than ink may be used. Further, the invention is applicable to various liquid ejecting apparatuses that include a liquid ejecting head or the like ejecting a minute amount of liquid droplet. In this case, the liquid droplet refers to a liquid state ejected from a liquid ejecting apparatus and includes liquids tailed in a granular shape, a teardrop shape, and a thread-like shape. Here, the liquid may be any material, as long as the liquid can be ejected by a liquid ejecting apparatus. Examples of the liquid include fluids such as a liquid containing a matter in a liquid-phase state and having high viscosity or low viscosity, sol, gel water, other inorganic solvents, organic solvent, a solution, a liquid resin, and a liquid metal (metallic melt). Further, an example of the liquid includes a liquid in which grains of a functional material formed of a solid matter such as a colorant or metal particles are resolved, dispersed, or mixed in a solvent. The representative examples of the liquid include ink described above and liquid crystal. Here, the ink is assumed to include various liquid compositions such as general water-based ink, oil-based ink, gel ink, and hot-melt ink.

In the above-described embodiment, the carriage 32 is moved only in the Y-axis positive direction in each sub-scanning process performed in one frame. However, the movement direction of the carriage 32 in the sub-scanning process is not limited to the Y-axis positive direction. That is, in each sub-scanning process performed in one frame, the carriage 32 may be moved in the Y-axis negative direction, and thus four line images may be arranged in the Y-axis negative direction. Alternatively, the sub-scanning process of moving the carriage 32 in the Y-axis positive direction and the sub-scanning process of moving the carriage 32 in the Y-axis negative direction may be performed in one frame.

In the above-described embodiment, the case in which the one-frame printing process is performed by four passes has been mainly exemplified. However, the number of passes forming the one-frame printing process is not limited to four passes. For example, the other plurality of passes or a single pass may form the one-frame printing process.

In the above-described embodiment, the invention has been applied to an ink jet printer using the piezoelectric method. However, the invention may, of course, be applied to an ink jet printer using a thermal method.

In the above-described embodiment, the case in which the carriage 32 reciprocates in the X-axis direction to perform the printing process has been exemplified. However, the invention may be applied to a configuration in which the carriage 32 is scanned only in one direction of the X-axis direction to perform the printing process.

This application claims the benefit of Japanese patent application No. 2011-159645, filed on Jul. 21, 2011, which is hereby incorporated by reference herein in its entirety.

What is claimed is:

1. An image recording apparatus that forms an image on a recording medium including a liquid accommodation layer by landing a liquid to the liquid accommodation layer of the recording medium, comprising:

a first unit that performs pre-processing of landing the liquid containing a material with absorbability lower than that of the liquid accommodation layer to an edge of an image formation region at which the image is scheduled to be formed; and a second unit that forms the image at the image formation region of the recording medium after the first unit performs the pre-processing;

wherein in the amount of liquid to be landed in the pre-processing, an amount present in the interior of the liquid accommodation layer is greater than an amount present on the surface of the liquid accommodation layer.

2. The image recording apparatus according to claim 1, wherein the recording medium further includes a transparent base layer and the liquid accommodation layer is laminated on the transparent base layer.

3. The image recording apparatus according to claim 2, wherein the liquid which the first unit lands to the recording medium in the pre-processing is a transparent liquid.

4. The image recording apparatus according to claim 1, wherein the recording medium further includes a colored base layer and the liquid accommodation layer is laminated on the base layer.

5. The image recording apparatus according to claim 4, wherein the liquid which the first unit lands to the recording medium in the pre-processing is a transparent liquid or the same color liquid as the color of the base layer.

6. An image recording method of forming an image on a recording medium including a liquid accommodation layer by landing a liquid to the liquid accommodation layer of the recording medium, comprising:

performing pre-processing of landing the liquid containing a material with absorbability lower than that of the liquid accommodation layer to an edge of an image formation region at which the image is scheduled to be formed, wherein in an amount of liquid to be landed in the pre-processing, an amount present in the interior of the liquid accommodation layer is greater than an amount present on the surface of the liquid accommodation layer; and forming the image at the image formation region of the recording medium after performing the pre-processing.

7. A program causing an image recording apparatus to form an image on a recording medium including a liquid accommodation layer by landing a liquid to the liquid accommodation layer of the recording medium using a computer, the program causing the computer to execute:

performing pre-processing of landing the liquid containing a material with absorbability lower than that of the liquid accommodation layer to an edge of an image formation region at which the image is scheduled to be formed, wherein in an amount of liquid to be landed in the pre-processing, an amount present in the interior of the liquid accommodation layer is greater than an amount present on the surface of the liquid accommodation layer; and forming the image at the image formation region of the recording medium after performing the pre-processing.

8. A program recording medium recording the program according to claim 7.

9. A label producing method comprising:

performing pre-processing of landing a liquid containing a material with absorbability lower than that of a liquid accommodation layer included in a recording medium to an edge of an image formation region at which a label image is scheduled to be formed on the liquid accommodation layer of the recording medium, wherein in an amount of liquid to be landed in the pre-processing, an amount present in the interior of the liquid accommodation layer is greater than an amount present on the surface of the liquid accommodation layer;

forming the label image at the image formation region of the recording medium after performing the pre-processing; and producing a label by cutting the formed label image from the recording medium, after forming the label image.

10. The label producing method according to claim 9, wherein in the producing the label, the label image is cut at a region including the liquid, when the label image is cut from the recording medium.

* * * * *